United States Patent [19]

Kimblin

[11] 4,426,560

[45] Jan. 17, 1984

[54] REDUCED PRESSURE ELECTRICAL SWITCH

[75] Inventor: Clive W. Kimblin, Churchill Borough, Pa.

[73] Assignee: Westinghouse Electric Corp., Pittsburgh, Pa.

[21] Appl. No.: 206,502

[22] Filed: Nov. 13, 1980

[51] Int. Cl.[3] ..... H01H 33/66

[52] U.S. Cl. ..... 200/144 B; 200/148 B; 200/148 G

[58] Field of Search ..... 200/144 B, 148 G

[56] References Cited

U.S. PATENT DOCUMENTS

| | | | |
|---|---|---|---|
| 1,313,856 | 8/1919 | Cavanagh | 200/144 B |
| 1,995,156 | 3/1935 | Proctor | 200/144 B |
| 1,997,288 | 4/1935 | Anderson | 200/144 B |
| 2,060,235 | 11/1936 | Miller | 200/144 B |
| 2,323,702 | 7/1943 | Berkey | 200/144 B |
| 2,975,255 | 3/1961 | Lafferty | 200/144 B |
| 3,014,107 | 12/1961 | Cobine et al. | 200/144 B |
| 3,156,803 | 11/1964 | Scully et al. | 200/144 B |
| 3,405,245 | 10/1968 | Toshio et al. | 200/144 B |
| 3,548,135 | 12/1970 | Wood | 200/144 B |
| 4,216,361 | 8/1980 | Salvatore | 200/144 B |

*Primary Examiner*—Robert S. Macon
*Attorney, Agent, or Firm*—W. G. Sutcliff

[57] ABSTRACT

An electrical switch for efficient, high continuous current carrying operation, with at least one movable contact for effecting current interruption. The ambient pressure within the volume defined by the electrical switch body is maintained at or is reducible during contact opening to between $10^{-1}$ to $10^{2}$ Torr to minimize contact erosion. A preferred electrical switch is a hermetically sealed, low voltage d.c., device for shunting an electrolyte cell. The sealed switch module has a reduced pressure atmosphere of inert fill gas at a pressure of from $10^{-1}$ to $10^{2}$ Torr.

5 Claims, 4 Drawing Figures

REDUCED PRESSURE ELECTRICAL SWITCH

BACKGROUND OF THE INVENTION

The present invention relates to electrical switching devices and more particularly to controlling the operating pressure of the device to minimize contact damage and erosion during the separation of the contacts.

The invention is applicable to a wide variety of electrical switches ranging from low voltage a.c. switch-contactors or circuit-breakers, which operate at from about 110 to 440 volts a.c., to highly specialized low d.c. voltage shunt bypass switches for electrochemical cells.

In the low voltage a.c. type switches used for distribution and motor control, the preferred contact material is an alloy containing significant proportions of silver, which is a high cost noble metal. These type of switches are typically open to ambient atmospheric pressure air. Silver is used as the contact because silver forms a conducting oxide which maintains high electrical conductivity and efficient current flow through the closed switch contacts. Recent shortages of materials such as silver have dramatically increased the cost of such contacts, and it is obviously desirable to eliminate or minimize the need for high cost, noble metal contact constituents.

In low voltage d.c. shunt bypass switches for electrochemical cells, which are operated at typically less than 10 volts d.c. with continuous current ratings of about 6,000 amperes for a single switch, the switch is typically a hermetically sealed, high vacuum device. The contacts are typically copper or copper-bismuth, high conductivity material, with requisite weld-break characteristic upon switch opening. The oxide of copper is a poor conductor and the vacuum condition within the switch prevents oxidation of the copper contacts.

When switch contacts are moved apart to interrupt the current flow an arc forms between the parted contacts with localized heating and erosion occurring till the arc is extinguished.

The present inventor had earlier observed and reported that the vacuum-arc cathode erosion rate can be decreased by more than an order of magnitude with increasing ambient pressure, as reported in "*Cathode Spot Erosion And Ionization Phenomena In Transition From Vacuum To Atmospheric Pressure Arcs*" Journal of Applied Physics, Volume 45, Number 12, pp. 5235–5244 (1974), and in "*Anode Phenomena In Vacuum And Atmospheric Pressure Arcs*", Volume PS-2, pp. 310–319, December 1974.

In an early work by others, "*Arc Cathodes of Low Current Density at High Amperage*", Journal of Applied Physics, Vol. 13, February 1942, p. 113–116, it was reported that arcs with low current density cathodes could be formed in low density gas to reduce electrode surface destruction.

SUMMARY OF THE INVENTION

The electrical switch devices of the present invention comprise a body portion which defines a volume within which the switching current or arc is interrupted. The body portion includes a flexible portion with at least one movable electrical contact supported from the flexible body portion and is movable therewith into and away from electrical contact with an opposed electrical contact. The ambient pressure within the volume defined by the body portion is maintained at or is reducible during contact opening to between about $10^{-1}$ to $10^{2}$ Torr to minimize contact damage and erosion during contact opening. The use of expensive silver or noble metal contacts can be minimized or eliminated.

A hermetically sealed switch module embodiment comprises an annular insulating envelope portion, annular flexible, corrugated diaphragm members extending transversely inwardly from the annular insulating envelope portion to cylindrical conductive contact members. The hermetically sealed switch module has a reduced pressure atmosphere which is maintained at from about $10^{-1}$ to $10^{2}$ Torr.

DESCRIPTION OF THE PREFERRED EMBODIMENTS

Figure 1:
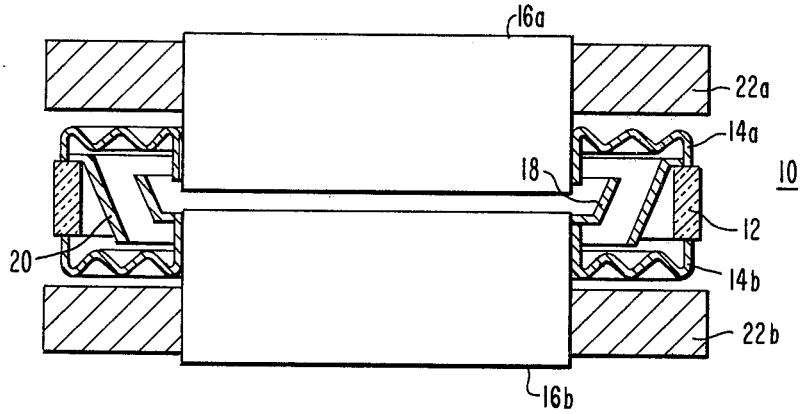
FIG. 1 is a side elevation view, partly in section of an electrical switch embodiment of the present invention.
Figure 2:
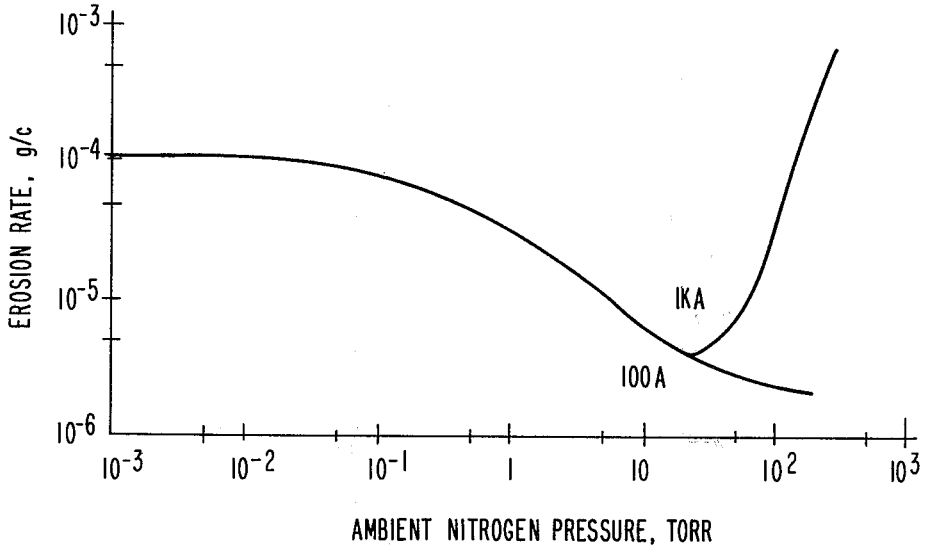
FIG. 2 is a plot of the variation of cathode erosion rate in grams per coulomb versus ambient nitrogen pressure in Torr, for copper cathodes at 100 ampere and 1000 ampere arcs.

The present invention can be understood by reference to the embodiments seen in the drawings. In FIG. 1, the electrical switch 10 has the basic structure of a low voltage d.c., hermetically sealed, shunt bypass switch as described in U.S. Pat. No. 4,216,361. In the prior art hermetically sealed switch, a high vacuum of about $10^{-4}$ Torr or greater is maintained in the switch. In such electrochemical cell bypass vacuum switches, the design conditions are for less than about 10 volts d.c. and about 6000 amperes continuous current.

This shunt bypass switch 10 comprises an annular insulating body portion 12, with annular flexible corrugated diaphragm members 14*a*, 14*b* extending transversely from the body portion to cylindrical conductive contacts 16*a*, 16*b*. A hermetical seal is formed between the inner and outer extensions of the diaphragm member and the body portion 12 and the contacts 16*a*, 16*b* to define a switch volume. A pair of spaced apart, angled annular arc shield means, inner arc shield 18 or outer arc shield 20, are disposed within this switch volume about the contacts 16*a*, 16*b* to intercept hot, eroded material from the contacts during arc interruption.

In the switch of the present invention, the erosion of contact material can be minimized by maintaining an ambient pressure within the switch volume which is between $10^{-1}$ to $10^{2}$ Torr. A non-oxidizing fill gas such as nitrogen, helium, argon is preferably introduced during fabrication of the switch and pumped down to the desired ambient pressure of $10^{-1}$ to $10^{2}$ Torr, to minimize oxidation of the contacts 16*a*, 16*b* which could, for example, be copper or copper alloys and mixtures.

The planar conductive mounting plates 22*a*, 22*b* connected to the cylindrical contacts 16*a*, 16*b* outside the switch volume facilitate connection of the switch to the electrochemical cell terminals or bus connectors.

Figure 3:
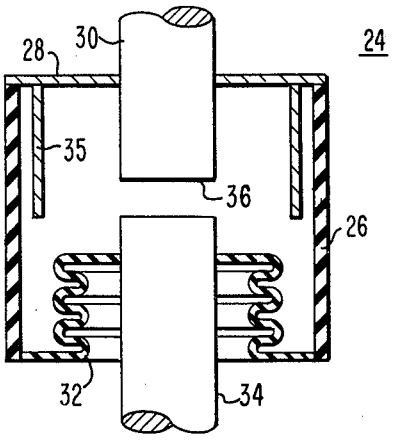
FIG. 3 is a schematic representation of another embodiment electrical switch per the present invention.

In the embodiment of FIG. 3, the electrical switch 24 comprises an insulating body portion 26, an end member 28 through which fixed contact 30 extends, and a bellows end portion 32 which a movable contact 34 extends. An annular arc shield 35 is disposed within the switch volume about the contacts 30 and 34. The annular arc shield 35 is supported by and extends from end member 28. This switch 24 can be hermetically sealed and filled to an ambient pressure within the switch of from about $10^{-1}$ to $10^{2}$ Torr. When the switch volume is sufficiently low relative to the bellows displacement volume the switch need not be hermetically sealed, but can utilize the bellows expansion on contact opening to reduce the ambient pressure from atmospheric to the preferred ambient pressure of $10^{-1}$ to $10^{2}$ Torr. When the electrical switch 24 is hermetically sealed, an inert fill gas such as argon or nitrogen at the desired fill pressure of $10^{-1}$ to $10^{2}$ Torr is provided. The electrial contacts are then preferably oxygen-free-high-conductivity copper. The inert gas fill ensure no oxidation of these contacts to keep the closed contact resistance low, and the reduced pressure minimizes contact erosion. The use of copper or copper alloy contacts instead of a noble metal such as silver permits a significant material cost saving.

In a switch embodiment as seen in FIG. 3, but which is not hermetically sealed, the extending ends or contact surfaces 36 associated with each contact 30 and 34 is formed of a noble metal such as silver or a high silver content alloy or compact, such as silver-tungsten, silver-cadmium oxide. The arcing in the reduced pressure will minimize erosion of these contacts.

Figure 4:
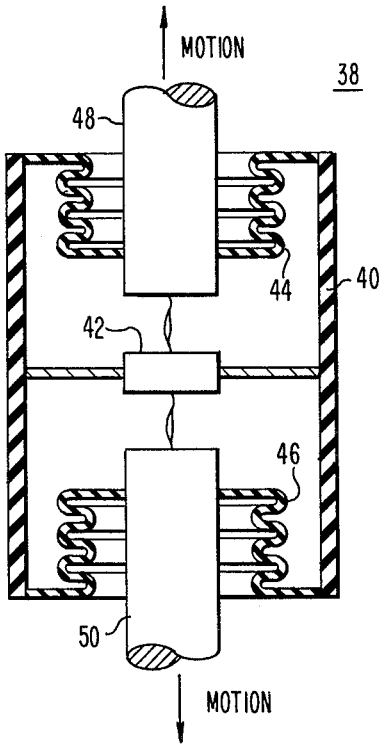
FIG. 4 is yet another switch embodiment in schematic representation.

The embodiment seen in FIG. 4 is designed for higher voltage operation. In order to provide adequate spacing and contact gap to prevent restriking of the extinguished arc a plural arc path is provided. The electrical switch 38 includes insulating body portion 40, a centrally disposed contact 42, and bellows end portions 44, 46 at each end of body portion 40. Movable contacts 48, 50 are supported respectively from bellows end portions 44 and 46. A pair of series arcs are formed when respective contacts 48 and 50 are separated from central contact 42. Again, the ambient pressure in which the arcs burn and are extingushed is determined to be from about $10^{-1}$ to $10^{2}$ Torr. As in the embodiment of FIG. 3 this can be achieved by having a hermetically sealed switch pumped down to the desired pressure, or by having sufficient bellows displacement upon contact separation that the desired ambient pressure is achieved. The reduced pressure switch seen in FIGS. 3 and 4 can be used in medium voltage a.c. circuit breaker systems. The reduced pressure within the switch minimizes contact erosion and permits use of copper or copper alloy contacts as opposed to silver contacts which have heretofore been necessary in atmospheric pressure air exposed contacts.

I claim:

1. In an electrical switch module for low voltage d.c., high continuous current operation and interruption, adapted for shunting an electrolytic cell, which electrical switch module is hermetically sealed and comprises an annular insulating envelope portion, annular flexible corrugated diaphragm members extending transversely inwardly from the annular insulating envelope portion to cylindrical conductive contact members, the improvement wherein the hermetically sealed switch module has a reduced pressure atmosphere which is maintained at from about $10^{-1}$ to $10^{2}$ Torr.

2. The device set forth in claim 1, wherein the switch module atmosphere is a non-oxidizing fill gas.

3. The electrical switching device set forth in claim 1, wherein the current carrying contact mating surfaces are formed of a high conductivity metal or alloy which is not a noble metal or alloy thereof.

4. The switching device set forth in claim 1, wherein the body portion is a hermetically sealed body.

5. The switching device set forth in claim 1, wherein the volume defined by the body portion is low enough and the flexibility of the flexible body portion such that expansion of the volume upon contact opening is sufficient to reduce the ambient pressure within the volume to the desired range.

* * * * *